US008025168B2

(12) United States Patent
Bullard et al.

(10) Patent No.: US 8,025,168 B2
(45) **Date of Patent: *Sep. 27, 2011**

(54) APPARATUS AND METHOD FOR THE SEPARATE STORAGE AND MIXING OF SUBSTANCES

(75) Inventors: Brian L. Bullard, Elk Grove, CA (US); Jon Hull, Rancho Santa Margarita, CA (US)

(73) Assignee: Brian L. Bullard, Elk Grove, CA (US)

( * ) Notice: Subject to any disclaimer, the term of this patent is extended or adjusted under 35 U.S.C. 154(b) by 53 days.

This patent is subject to a terminal disclaimer.

(21) Appl. No.: 12/464,371

(22) Filed: May 12, 2009

(65) Prior Publication Data

US 2009/0301905 A1 Dec. 10, 2009

Related U.S. Application Data

(63) Continuation-in-part of application No. 12/134,161, filed on Jun. 5, 2008.

(51) Int. Cl.
*B65B 1/04* (2006.01)

(52) U.S. Cl. ..... 215/11.1; 215/221; 426/117

(58) Field of Classification Search ..... 215/11.1; 206/221; 126/263.08; 222/83
See application file for complete search history.

(56) References Cited

U.S. PATENT DOCUMENTS 2,786,769 A * 3/1957 Greenspan ..... 426/117
2,793,776 A * 5/1957 Lipari ..... 206/221
3,156,369 A 11/1964 Bowes et al.
3,355,047 A * 11/1967 De Sole ..... 215/11.1
3,613,955 A 10/1971 Wetherell
4,024,952 A 5/1977 Leitz
4,386,696 A 6/1983 Goncalves
4,610,374 A 9/1986 Buehler
4,651,899 A 3/1987 Pauls et al.
4,930,645 A * 6/1990 Warehime ..... 215/11.1
5,186,323 A * 2/1993 Pfleger ..... 206/221
5,275,298 A 1/1994 Holley, Jr. et al.
5,295,597 A 3/1994 Green
5,353,964 A 10/1994 Liu et al.
(Continued)

OTHER PUBLICATIONS

International Search Report and Written Opinion, dated Jan. 18, 2010, from Application No. PCT/US2009/046129.

(Continued)

*Primary Examiner* — Anthony Stashick
*Assistant Examiner* — Cynthia Collado
(74) *Attorney, Agent, or Firm* — Fitch Even Tabin & Flannery

(57) ABSTRACT

A storage device has a second cap for actuating a rod and permitting a fluid to flow through that cap. The storage device has an outer container and an inner container. Mounted at one end of the inner container is a first cap that rotates open and closed for allowing the contents of the inner and outer containers to mix together when desired. The other end of the inner container has an opening that is enclosed by the second cap that is operable to actuate the rod. When actuated, the rod pushes against the first cap thereby opening it in order to mix the contents. Moreover the second cap defines a plurality of holes adapted to permit a fluid to flow through them. Thus the second cap actuates the rod, yet also is disposed at the same end of the outer and inner containers from which the fluid can flow.

39 Claims, 13 Drawing Sheets

U.S. PATENT DOCUMENTS

| | | | | |
|---|---|---|---|---|
| 5,419,445 | A | | 5/1995 | Kaesemeyer |
| 5,467,877 | A | * | 11/1995 | Smith ..... 215/11.1 |
| 5,540,341 | A | | 7/1996 | Holley et al. |
| 5,542,922 | A | | 8/1996 | Petterson et al. |
| 5,593,028 | A | | 1/1997 | Haber et al. |
| 5,634,714 | A | | 6/1997 | Guild |
| 5,692,644 | A | | 12/1997 | Gueret |
| 5,772,017 | A | | 6/1998 | Kang |
| 5,794,802 | A | | 8/1998 | Caola |
| 6,079,405 | A | | 6/2000 | Justo |
| 6,152,296 | A | * | 11/2000 | Shih ..... 206/222 |
| 6,386,872 | B1 | | 5/2002 | Mukasa et al. |
| 6,474,861 | B1 | | 11/2002 | De Laforcade |
| 6,655,525 | B2 | | 12/2003 | Song |
| 6,854,595 | B2 | | 2/2005 | Kiser |
| 6,920,991 | B2 | | 7/2005 | Holley |
| 6,926,138 | B1 | | 8/2005 | Basham et al. |
| 7,055,684 | B2 | | 6/2006 | Anderson |
| 7,635,012 | B2 | * | 12/2009 | Johns et al. ..... 141/322 |
| 2004/0149768 | A1 | | 8/2004 | Scoville |
| 2006/0113201 | A1 | | 6/2006 | Micic et al. |
| 2007/0017890 | A1 | | 1/2007 | Al-Jadh |
| 2009/0301904 | A1 | | 12/2009 | Bullard |

OTHER PUBLICATIONS

European Patent Publication No. 0392609B1, published Mar. 30, 1994.

International Application Publication No. WO97/16101, published May 9, 1997.

International Application Publication No. WO09/149184A2, published Dec. 10, 2009, for Application No. PCT/US09/046129 filed Jun. 3, 2009.

* cited by examiner

APPARATUS AND METHOD FOR THE SEPARATE STORAGE AND MIXING OF SUBSTANCES

CROSS REFERENCE TO RELATED APPLICATIONS

This is a continuation-in-part application that claims priority from U.S. application Ser. No. 12/134,161, filed Jun. 5, 2008, which such application is incorporated herein by reference as if fully set forth herein.

FIELD OF INVENTION

This relates to a container that can separately store at least two substances, and when desired, mix these substances together.

BACKGROUND

When two substances, such as a powder and a liquid for example, are mixed together and stored in a container for a relatively short period of time, it sometimes happens that their properties are such that the mixture degrades or is otherwise rendered unusable for its intended purpose. One example involves dry powder baby formula that is designed to be mixed with water. When separately stored, the powder formula and the water can be kept in a usable condition for a relatively long period of time. When mixed together however, the resulting solution spoils rather quickly and is no longer usable. There is a need therefore for a container which is capable of separately storing two or more substances and of mixing them when desired.

Various known containers and devices were designed to achieve this purpose. However, many of them have disadvantages including high manufacturing costs, complicated structures, one-time use capability only, unreliable operation, difficulty in achieving good mixing results, inconvenient or awkward actuation for causing the substances to mix together, and/or difficulty in cleaning and re-assembly, etc. There is therefore a need for improved devices and methods for storing and mixing substances in order to overcome some or all of the foregoing disadvantages.

SUMMARY OF THE ILLUSTRATED EMBODIMENTS

Embodiments of the invention include a device having an outer container and an inner container. Mounted at one end of the inner container is a first cap that rotates open and closed via a hinge. When the first cap is opened, the contents of the inner and outer containers are allowed to mix together. The other end of the inner container has an opening that is enclosed by a second cap operable to actuate a rod. When actuated, the rod pushes against the first cap thereby opening it and permitting the contents of the inner and outer containers to mix together.

In an alternative embodiment of the invention, a device for holding a first substance and a second substance comprises a first container defining a first chamber for containing the first substance and a second container defining a second chamber for containing the second substance. The second container further defines second container proximate and distal openings, each of which leads into the second chamber.

A first cap is coupled to the second container and configured for movement from a sealing position to an open position and for movement from the open position to the sealing position. The first and second chambers are in a first state when the first cap is in the sealing position and are in a second state when the first cap is in the open position. The first state is the first and second chambers being sealed from one another, and the second state is the first and second chambers being in communication with one another. The first cap is configured to cover the second container proximate opening when the first cap is in the sealing position. An operating member is configured to move the first cap from the sealing position to the open position.

A second cap is configured to cover the second container distal opening. At least a portion of the second cap is movable between a cap first position and a cap second position. The operating member is configured to be coupled to the second cap and to be moved by the second cap when the at least a portion of the second cap moves from the cap first position to the cap second position. The second cap defines a plurality of second cap holes configured to permit the first substance and the second substance to pass through these holes.

In yet another embodiment, a device comprises a first container defining a first chamber for containing the first substance and a second container defining a second chamber for containing the second substance. A first cap is configured for movement from a closed or sealing position to an open position and for movement from the open position to the sealing position. The first cap is coupled to either the first container or the second container when the first cap is both in the sealing position and in the open position.

The first and second chambers are in a first state when the first cap is in the sealing position, and they are in a second state when the first cap is in the open position. The first state is the first and second chambers being sealed from one another, whereas the second state is the first and second chambers being in communication with one another. An operating member is configured to move the first cap from the sealing position to the open position upon actuation of the operating member. The first container, the second container and the first cap are configured so that the first and second chambers can alternate a plurality of times between the first state and the second state during normal usage.

In yet another embodiment, a baby bottle for use with a nipple is provided. A first container defines a proximate first container opening, a distal first container opening, and a first chamber. The proximate first container opening is configured to be closed by the nipple. A second container defines a second container proximate opening, a second container distal opening, and a second chamber. A first cap is pivotally mounted on the second container and has an open position and a sealing position. The first cap is configured to cover the second container proximate opening when the first cap is in the sealing position. A second cap is configured to enclose the second container distal opening. At least a portion of the second cap is movable between a cap first position and a cap second position.

A rod is configured for coupling to the second cap and for extending in a direction toward the second container proximate opening when the second cap encloses the second container distal opening. The rod is further configured to move between a rod first position and a rod second position in response to movement of the at least a portion of the second cap between the cap first position and the cap second position. At least a portion of the second container is configured to be disposed within the first chamber so that the second chamber is in communication with the first chamber via the second container proximate opening when the first cap is in the open position. The rod, the first cap and the second cap are configured so that the first cap is moved from the closed position to the open position in response to movement of the rod from the rod first position to the rod second position.

In yet another embodiment, a device for holding a first substance and a second substance is provided. A first container defines a first chamber for containing the first substance. A second container defines a second chamber for containing the second substance. The first and second containers are configured so that at least a portion of the second container can be inserted into the first container. The second container defines a second container proximate opening leading into the second chamber. The second chamber is configured to be in communication with the first chamber via the second container proximate opening when the second container is inserted into the first container. The device further includes means for alternately closing and opening the second container proximate opening a plurality of times, wherein the first and second chambers are not in communication with one another each time that the second container opening is closed and wherein the first and second chambers are in communication with one another each time that the second container proximate opening is opened.

In yet another embodiment, a method of using a baby bottle for mixing a first substance and a second substance is provided. The first substance is placed into the baby bottle through a bottle opening defined by the baby bottle. The second substance is placed into a second container. The second container defines a container proximate opening and a container distal opening, and is configured for use with a first cap configured to cover the container proximate opening. An actuating cap is placed over the container distal opening. At least a portion of the second container is inserted into the bottle opening thereby positioning the first cap within the baby bottle. A nipple that is configured to cover the actuating cap and that is disposed adjacent to the actuating cap is pushed. The actuating cap is moved in response to the pushing of the nipple thereby moving an operating member which in turn opens the first cap thus allowing the first and second substances to mix.

In yet another embodiment, a first container and a second container are provided wherein the first container defines a first chamber containing a first substance and the second container defines a second chamber containing a second substance. An operating member, such as for example a rod, is actuated. A first cap is moved from a sealing position to an open position in response to the actuation of the operating member. The first cap is coupled to either the first container or the second container. However the first cap remains coupled to either the first or second container when the first cap is both in the sealing and the open positions. If the first cap is in the sealing position, it is disposed between the first chamber and the second chamber. On the other hand if the first cap is in the open position, the first chamber is in communication with the second chamber. The first substance is then mixed with the second substance.

In yet another embodiment, at least a portion of a second container is inserted into a first container. The second container is configured for use with a first cap and a second cap. A second substance is placed into the second container through a second container distal opening defined by the second container. The second container distal opening is enclosed with the second cap. A first substance is placed into the first container through a proximate first container opening defined by the first container. The proximate first container opening is enclosed. The second cap is pushed thereby actuating an operating member and opening the first cap.

There are additional aspects to the present inventions. It should therefore be understood that the preceding is merely a brief summary of some embodiments and aspects of the present inventions. Additional embodiments and aspects are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

BRIEF DESCRIPTION OF THE DRAWINGS

These and/or other aspects and advantages of the present invention will become apparent and more readily appreciated from the following description of certain embodiments, taken in conjunction with the accompanying drawings of which.

DETAILED DESCRIPTION

Figure 1:
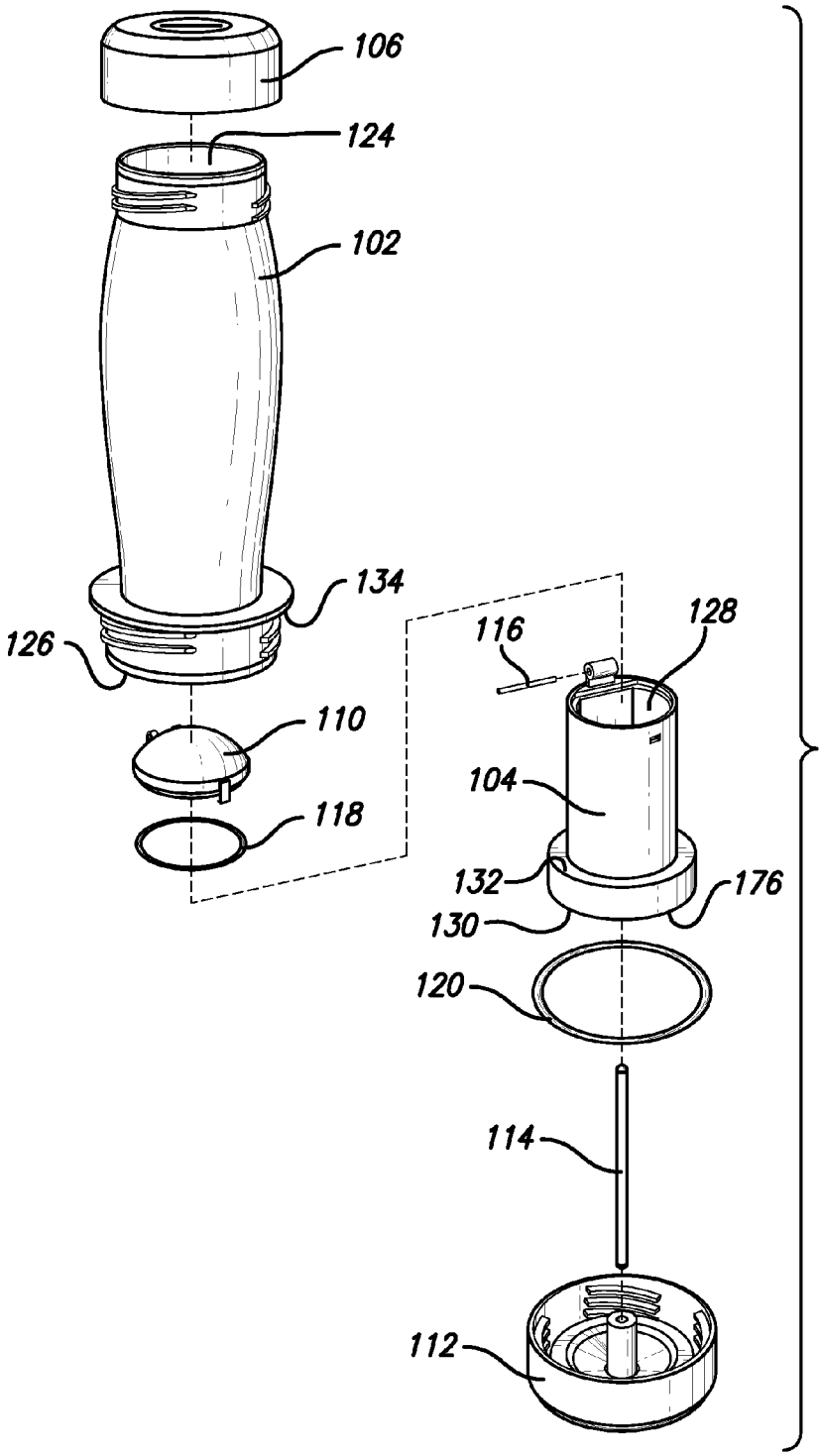
FIG. 1 is an exploded parts diagram of a baby bottle in accordance with one embodiment of the invention.

The following description is of the best mode presently contemplated for carrying out the invention. Reference will be made in detail to embodiments of the present invention, examples of which are illustrated in the accompanying drawings, wherein like reference numerals refer to like elements throughout. It is understood that other embodiments may be used and structural and operational changes may be made without departing from the scope of the present invention.

Figure 2:
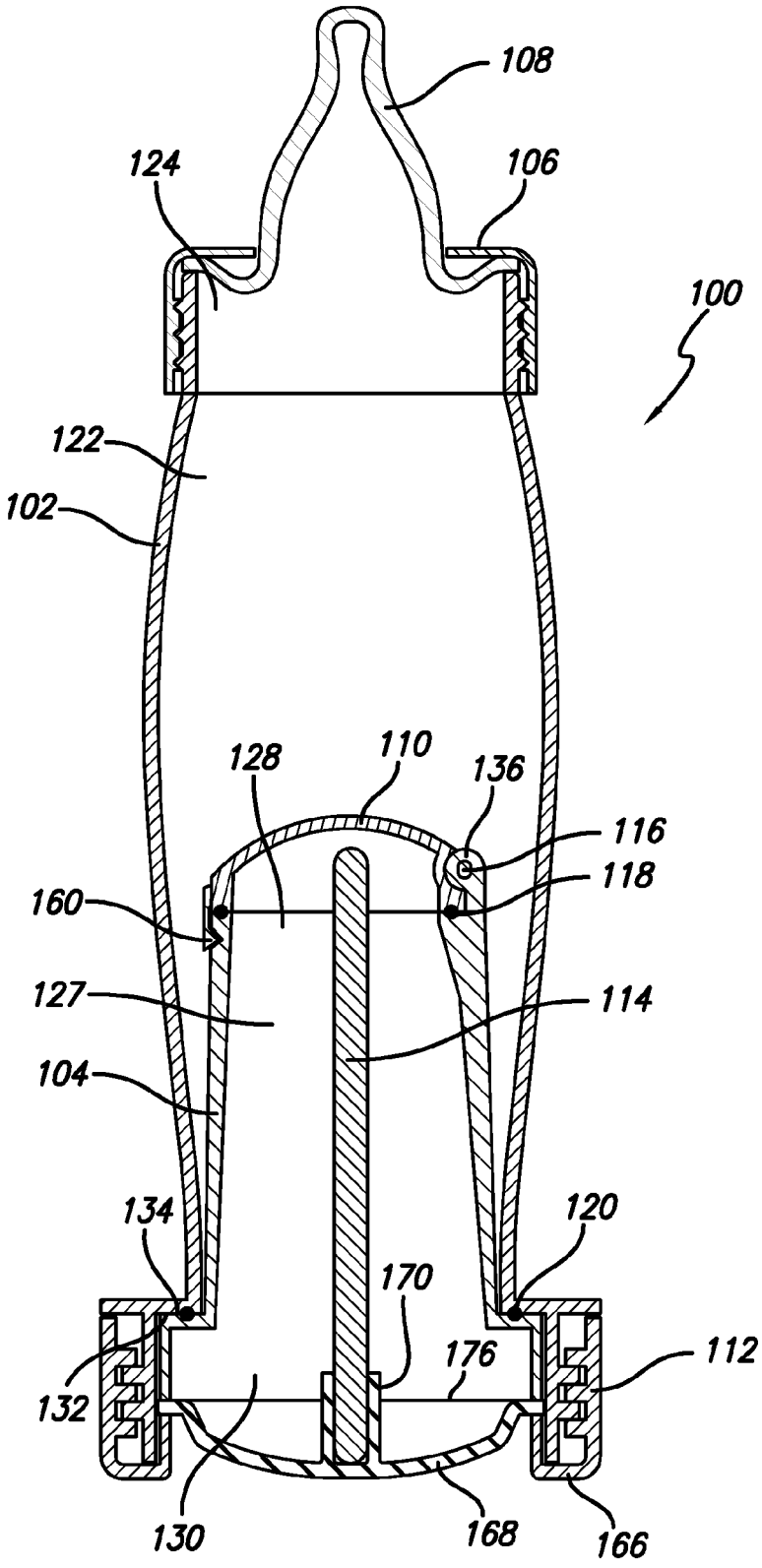
FIG. 2 is a cross section view of the assembled baby bottle of FIG. 1.

Referring to FIGS. 1 and 2, there is shown a baby bottle 100 that includes a first (or outer) container 102 for holding a first substance (not shown), a second (or inner) container 104 for holding a second substance (not shown), a cap ring 106, a nipple 108, a first cap 110, a second cap 112, an operating member or rod 114, a hinge pin 116, an upper O-ring 118 and a lower O-ring 120.

The first container 102 is generally elongated in shape and defines a first chamber 122, a proximate first container opening 124 at one end of the first container 102 and leading into the first chamber 122, and a distal first container opening 126 at the opposite end of the first container 102 and also leading into the first chamber 122. The nipple 108 is configured to cover the proximate first container opening 124, and the cap ring 106 is configured for removable, threaded engagement with the first container 102 so that it secures the nipple 108 in place with a fluid-tight seal.

The second container 104 also is generally elongated in shape and defines a second chamber 127, a second container proximate opening 128 at one end of the second container 104 and leading into the second chamber 127 and a second container distal opening 130 at the opposite end of the second container 104 and also leading into the second chamber 127. The first and second containers 102, 104 are removable from one another during normal usage by an end user and are configured to mate with one another in a generally coaxial relationship. That is, the second container 104 can be inserted through the distal first container opening 126 and can be disposed within the first chamber 122 so that the distal first container opening 126 is sealed closed by the second container 104. The sealing of the distal first container opening 126 is accomplished by a ledge 132 on the second container 104 that seats on a corresponding ledge 134 of the first container 102 with the lower O-ring 120 disposed between the ledges 132, 134 as best seen in FIG. 2.

Figure 5:
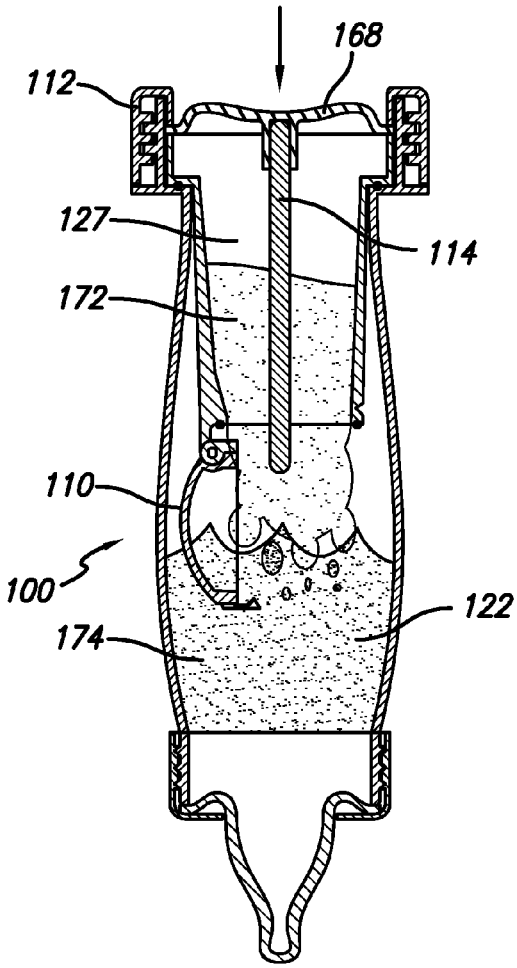
FIG. 5 is a cross section view of the baby bottle of FIG. 4 but inverted and with the second cap in a second position for allowing the two substances to mix with one another.

The first cap 110 is pivotally mounted on the second container 104 with a hinge 136 that is disposed at a location adjacent to the second container proximate opening 128. Thus the first cap 110 is configured so that it can rotate or move from a closed or sealing position to an open position as well as from the open position to the sealing position. When the first cap 110 is in the sealing position as shown in FIG. 2, it abuts the upper O-ring 118 and covers the second container proximate opening 128 so that the first and second chambers 122, 126 are in a first condition or state, i.e., they are sealed from one another thereby keeping the first and second substances separated from one another. On the other hand, when the first cap 110 is in the open position as shown in FIG. 5, the first and second chambers 122, 126 are in a second state, i.e., they are in communication with one another, thereby permitting the first and second substances to mix with one another. Moreover, this open position allows the second container proximate opening 128 to be fully uncovered thus exposing the full, radial cross-section area of the second chamber 127 to the first chamber 122 for optimum mixing of the substances.

Figure 10A:
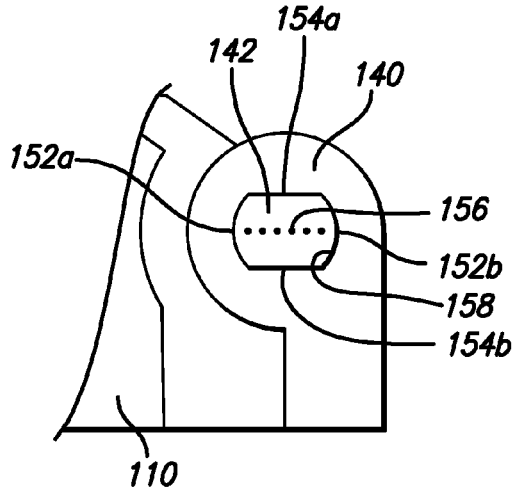
FIG. 10A is an enlarged view of a portion of FIG. 9 showing a portion of a hinge that is associated with the first cap.
Figure 10B:
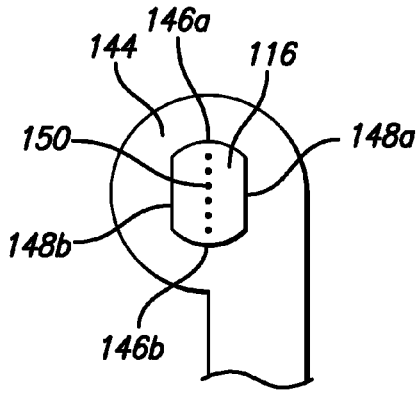
FIG. 10B is an enlarged view of a portion of FIG. 9 showing another portion of the hinge that is associated with the second container.
Figure 6:
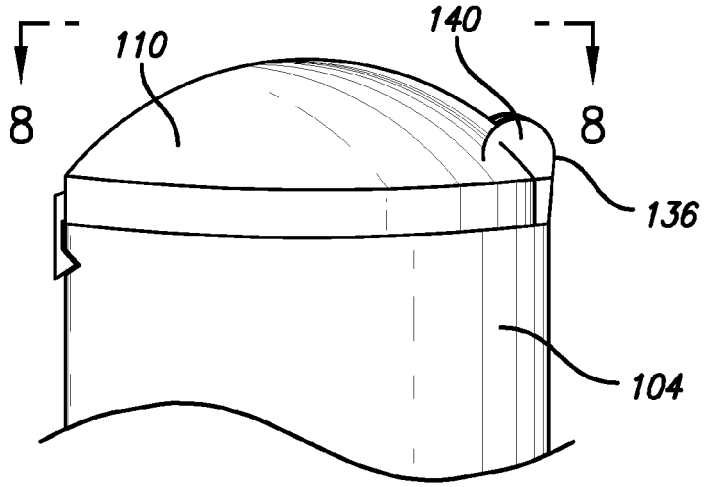
FIG. 6 is a perspective view of the first cap in the sealing position and an upper portion of the second container of the baby bottle of FIG. 2.
Figure 7:
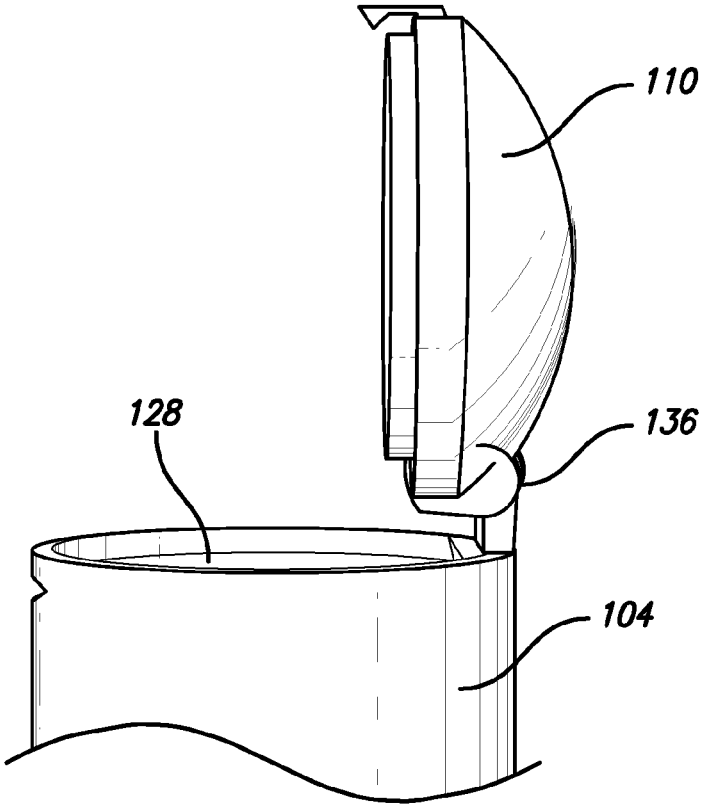
FIG. 7 is a perspective view of the first cap in the open position and an upper portion of the second container of the baby bottle of FIG. 2.
Figure 8:
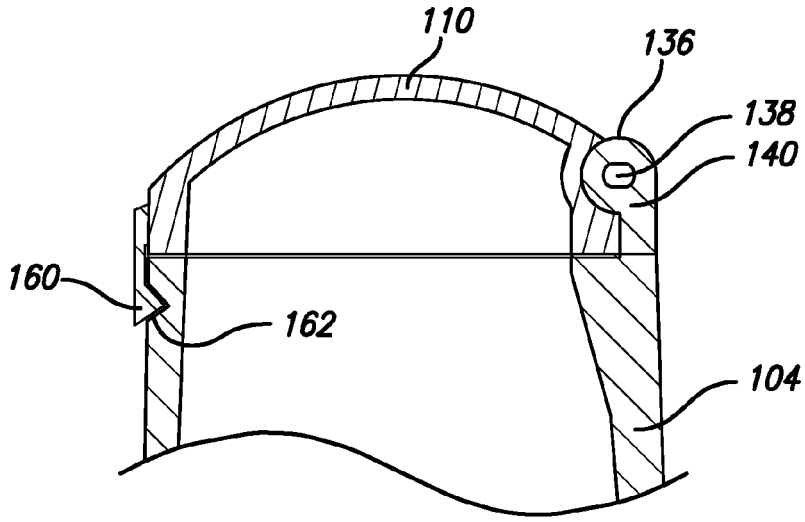
FIG. 8 is a cross section view of the first cap and the upper portion of the second container along lines 8-8 of FIG. 6.
Figure 9:
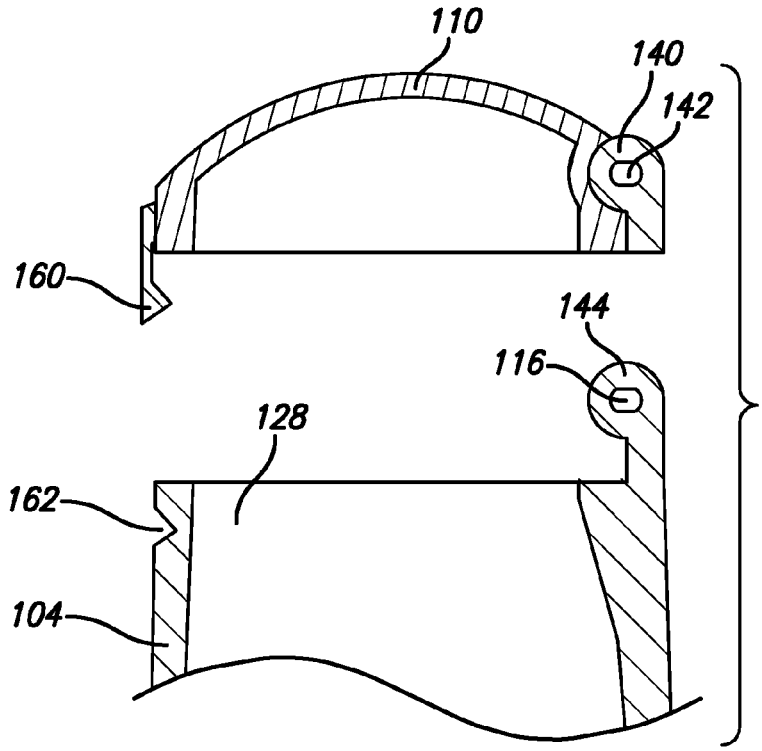
FIG. 9 is a cross section view of the components of FIG. 8 but with the first cap detached from the second container.

FIGS. 6 and 7 are perspective views of the hinge 136, the first cap 110 and an upper portion of the second container 104 when the first cap 110 is in the sealed and open positions, respectively. FIG. 8 shows a cross section view of the hinge 136, the first cap 110 and the upper portion of the second container 104 along the lines 8-8 of FIG. 6. FIG. 9 shows a cross section view of these same components of FIG. 8, but with the first cap 110 detached from the second container 104 for clarity of illustration. FIGS. 10A and 10B are enlarged views of portions of FIG. 9, wherein FIG. 10A shows a portion of the hinge 136 that is associated with the first cap 110, and wherein FIG. 10B shows another portion of the hinge 136 that is associated with the second container 104.

Referring now to these FIGS. 6 to 10A and 10B, the hinge 136 comprises the pin 116 and a hinge member 140. The hinge member 140 is part of the first cap 110 and defines a hinge cavity 142 configured to receive the pin 116. The pin 116 is fixedly secured into a pin housing 144 so as to inhibit rotation of the pin 116. The pin housing 144 is integral with the second container 104 and extends upwardly from and above the second container proximate opening 128. Although FIG. 10A shows one hinge member 140 and hinge cavity 142, the first cap 110 in fact includes two hinge members and hinge cavities disposed in a spaced-apart relationship so that the pin 116 is disposed between them such that each hinge cavity receives one or the other end of the pin 116.

As best seen in FIG. 10B, the pin cross section geometry defines a shape that is generally elongated, has two generally arcuate-shaped sides 146*a*, 146*b* connected by two generally linearly-shaped sides 148*a*, 148*b*, and includes an imaginary pin cross section longitudinal axis 150. As best seen in FIG. 10A, the cavity cross section geometry similarly defines a shape that is generally elongated, has two generally arcuate-shaped sides 152*a*, 152*b* connected by two generally linearly-shaped sides 154*a*, 154*b*, and includes an imaginary cavity cross section longitudinal axis 156.

The hinge cavity 142 has a cavity wall 158 and is configured to permit relative rotation between the cavity wall 158 and the pin 116 when the first cap 110 moves between the sealing position and the open position. The pin 116 and hinge cavity 142 are configured so that the imaginary pin cross section longitudinal axis 150 is oriented generally normal to the imaginary cavity cross section longitudinal axis 156 if the first cap 110 is in the sealed position as shown in FIGS. 9, 10A and 10B. On the other hand, the imaginary pin cross section longitudinal axis 150 is generally aligned with the imaginary cavity cross section longitudinal axis 156 if the first cap 110 is in the open position. It thus can be seen that when the first cap 110 is in the open position either no stress or a relatively low stress is exerted between the pin 116 and the cavity wall 158, because the pin cross section and the cavity cross section geometries are generally aligned with one another. On the other hand when the first cap 110 is in the sealing position, the pin and cavity cross sections are out of alignment as shown in FIGS. 10A and 10B so that a relatively larger stress is exerted between the pin 116 and the cavity wall 158.

The cavity wall 158 and the pin 116 each is constructed of a resilient material, such as plastic, so as to permit an out-of-alignment, relative movement and orientation. Nevertheless, the pin 116 is constructed of a material having a greater hardness (although still resilient) than that of the hinge member 140 so as to improve the hinge 136 operation. (In alternative embodiments, this can be reversed so that the hinge member 140 is constructed of a material having a greater hardness than that of the pin 116, or alternatively still, they can be constructed of materials having generally the same hardness.) Thus when the first cap 110 moves from the sealing to the open position, the first cap 110 will have a tendency to snap into place and remain in a fully-opened position due to the reduced stress (or no stress) between the pin 116 and the cavity wall 158. However when the baby bottle 100 is disassembled and a user wants to close the first cap 110, the user can move the first cap 110 back to the sealing or closed position by rotating it about the hinge 136 with enough force to overcome the stress between the pin 116 and cavity wall 158. When placed into the sealed position, a latch 160 on the first cap 110 engages an indentation 162 in the wall of the second container 104 thereby securing the first cap 110 in the sealing position, as best seen in FIGS. 6 and 8.

Although FIGS. 8 to 10A and 10B depict a hinge pin and cavity arrangement having a particular geometry and cross section, it will be appreciated that alternative embodiments of the invention include other configurations and geometries wherein a stress is placed between a pin and cavity wall if the first cap 110 is in the sealing position and wherein a lesser stress (or no stress) exists if the first cap 110 is in the open position.

While FIGS. 8 to 10A and 10B disclose a hinge for connecting the first cap 110 to the second container 104, alternative embodiments include other fastening devices which can be used to secure the first cap 110 to either the second container 104, the first container 102 or to other components of the baby bottle 100. These alternative embodiments allow the first cap 110 to move from a sealing position to an open position and from the open position to the sealing position, so that the two chambers can alternate a plurality of times between the two states, i.e., sealed from one another on the one hand, and in communication with one another on the other hand.

Referring again to FIG. 2, the second cap 112 is comprised of a ring-shaped, rigid member 166 defining an opening, a flexible wall 168 or diaphragm attached to the rigid member 166 and extending across the opening, and a sleeve 170 extending axially upward from the flexible wall 168. The rigid member 166 is configured for threaded engagement with the first container 102 near the distal first container opening 126. (In alternative embodiments, the rigid member 166 can be configured for a snap-fit engagement with the first container 102.) Thus when the second container 104 is disposed in the first container 102, the flexible wall 168 of the second cap 112 is pressed against a rim 176 of the second container 104 (that forms the second container distal opening 130) thereby enclosing and sealing the second container distal opening 130. The rod 114 is coupled to the flexible wall 168 by insertion of one end of the rod 114 into the sleeve 170. When inserted into the sleeve 170, the rod 114 extends axially in a direction toward the second container proximate opening 128.

Figure 4:
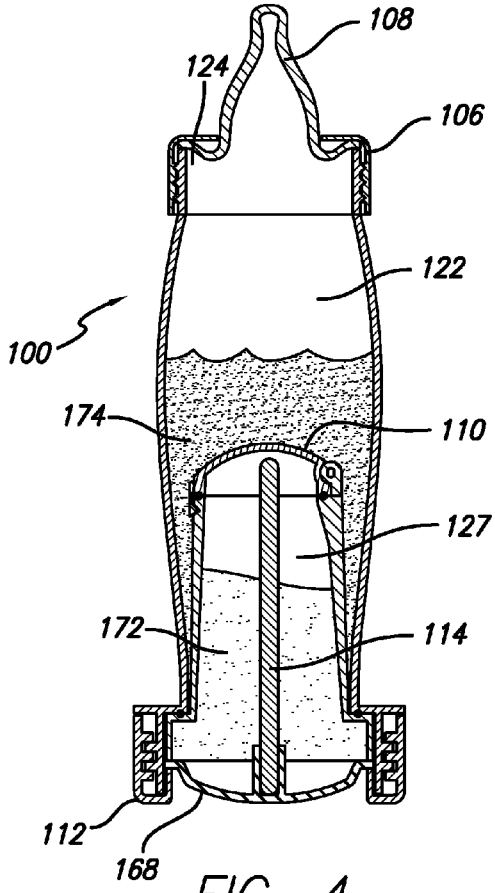
FIG. 4 is a cross section view of the baby bottle of FIG. 2 holding two substances that are separated from one another.

Thus it can be seen that when an external force is applied to the flexible wall 168 in a direction generally normal to it (such as by pushing the wall 168 with the thumb of a user in a single-handed operation), this causes the second cap 112 to move between a cap first position as shown in FIG. 4, wherein the flexible wall 168 is not depressed or deformed, to a cap second position as shown in FIG. 5, wherein the flexible wall 168 is depressed or deformed. This in turn moves or actuates the rod 114 in an axial direction from a rod first position as shown in FIG. 4 to a rod second position as shown in FIG. 5, thereby pushing the first cap 110 with enough force to overcome the holding force of the latch 160. The first cap 110 moves from the sealing position to the open position where it snaps into place (and remains in place) as a result of the reduced stress between the pin 116 and the cavity wall 158 as previously described.

It should be noted that the actuation of the rod 114 is by an axial movement of the second cap 112 resulting from a pushing force applied in a generally normal direction to the flexible wall 168, as shown by the arrow in FIG. 5, and that this axial movement has essentially no rotary component. Because there is essentially no rotary or twisting movement, the first cap 110 can be conveniently and easily opened by a user in a single-handed operation.

Thus it can be seen that the first cap 110, the hinge 136, the second cap 112 and the rod 114 comprise a means for alternately closing and opening the second container proximate opening 128 a plurality of times. During normal usage by an end user, the nipple 108, the cap ring 106, the first container 102, the second container 104, the second cap 112 and the rod 114 each can be disassembled from one another for cleaning and can be re-assembled for repeated use. The baby bottle 100 therefore can be used and reused a plurality of times so that the first and second chambers 122, 126 are sealed from one another for separately holding and storing two substances, such as water and a powder formula, and so that the first and second chambers 122, 126 can be placed in communication with one another when the user desires to mix these two substances.

Figure 3:
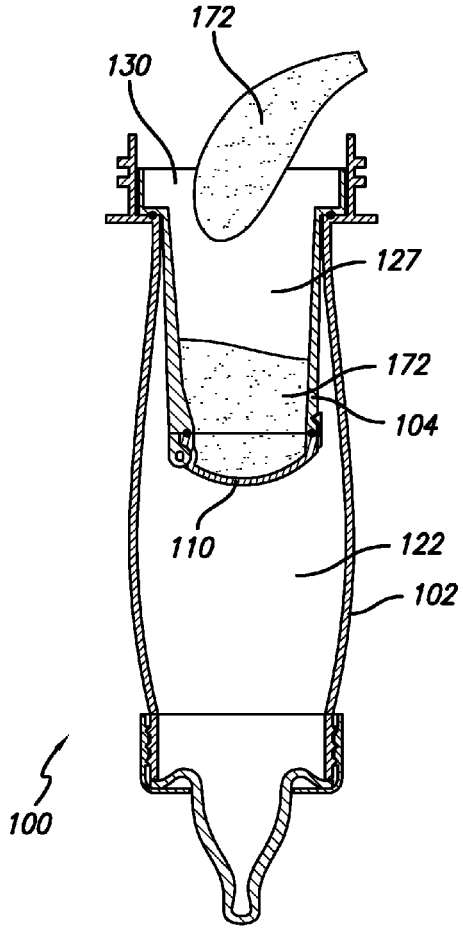
FIG. 3 is a cross section view of the baby bottle of FIG. 2 but inverted and with the second cap removed.

In operation, with the second cap 112 removed from the first container 102 and the baby bottle 100 inverted, a dry powder formula 172 is poured through the second container distal opening 130 into the second chamber 127 of the second container 104 as shown in FIG. 3. Then the second cap 112 is secured onto the first container 102 thus sealing shut the second container distal opening 130. The baby bottle 100 is restored to its upright position, the cap ring 106 and nipple 108 are removed, and water 174 is poured through the proximate first container opening 124 and into the first chamber 122 of the first container 102. The cap ring 106 and nipple 108 are then secured back onto the first container 102 thus enclosing the proximate first container opening 124. The dry powder formula 172 and the water 174 are now conveniently and separately contained within the baby bottle 100 for relatively long-term storage as shown in FIG. 4.

When a user desires to mix the water 174 and the dry powder formula 172, the baby bottle 100 is inverted, and the user pushes the flexible wall 168 of the second cap 112 in an easy, single-handed operation, as shown in FIG. 5. This actuates the rod 114 so that it moves axially in a direction toward the first cap 110 and so that it pushes the first cap 110 from the sealing position to the open position as is also shown in FIG. 5. With the first cap 110 in the open position, the second container proximate opening 128 is fully uncovered thus exposing the full, radial cross-section area of the second chamber 127 to the first chamber 122. This allows for a free and rapid flow of the dry powder formula 172 into the water 174 and provides for optimum mixing of these substances.

Figure 11:
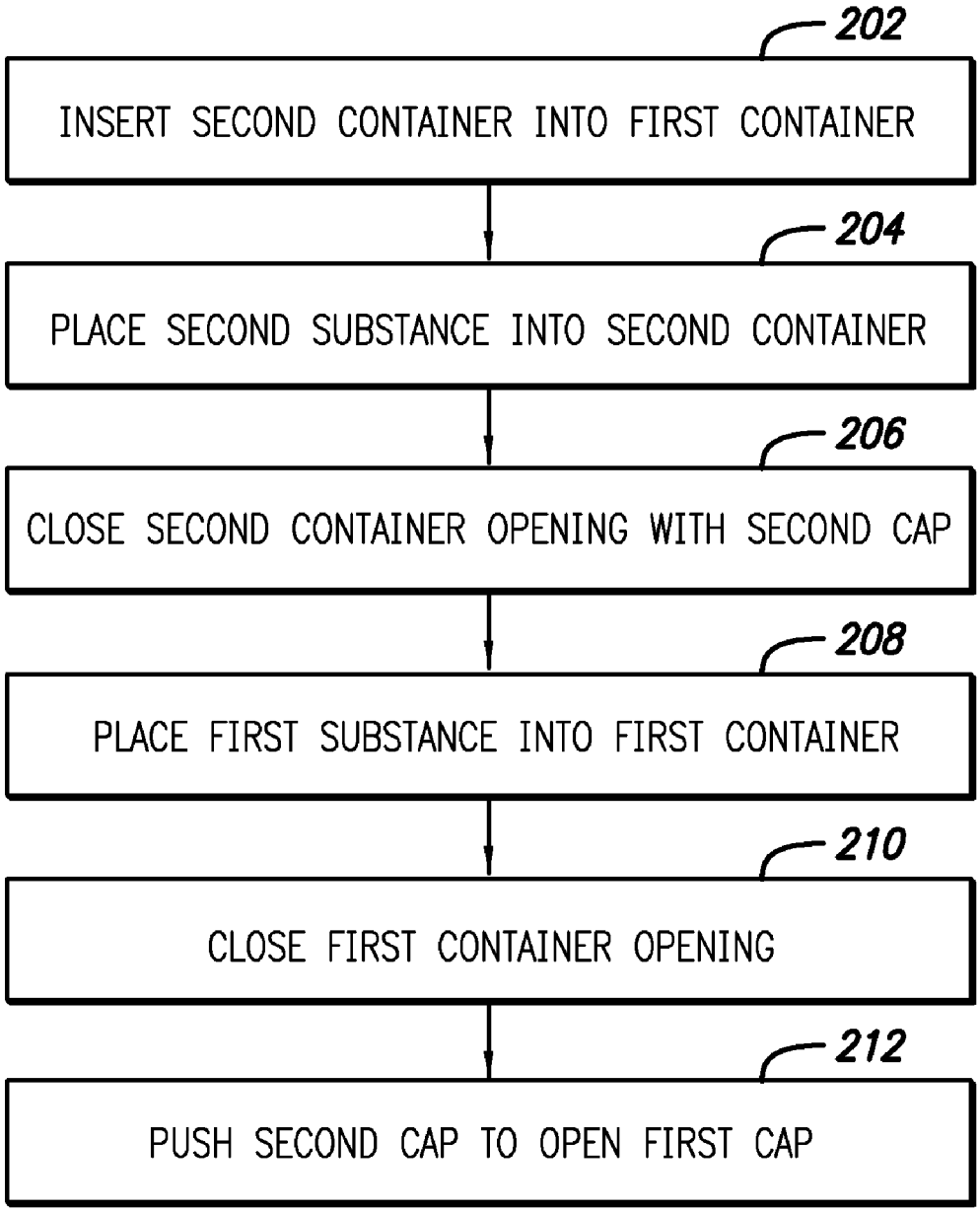
FIG. 11 is a simplified process flow diagram for a method of mixing a first substance and a second substance in accordance with another embodiment of the invention.

FIG. 11 is a simplified process flow diagram for a method of mixing a first substance and a second substance in accordance with another embodiment of the invention. A second container is inserted into a first container, wherein the second container is configured for use with a first cap and a second cap. (Step 202) The second substance is placed into the second container through a second container distal opening. (Step 204) The second container distal opening is closed with the second cap. (Step 206) The first substance is placed into the first container through a proximate first container opening. (Step 208) The proximate first container opening is sealed closed. (Step 210) When a user desires to mix the first and second substances, the second cap is pushed by the user thereby actuating an operating member which in turn opens the first cap. (Step 212). Once the first cap is opened, the chamber of the second container is in communication with the chamber of the first container, thus allowing the first and second substances to mix with one another.

An alternative embodiment of the invention includes a device, such as a baby bottle, that has a cap for both actuating a rod and permitting a fluid to flow through the cap. As before, this device has an outer container and an inner container. Mounted at one end of the inner container is a first cap that rotates open and closed via a hinge that is disposed within the inner container. When the first cap is opened, the contents of the inner and outer containers are allowed to mix together. The other end of the inner container has an opening that is enclosed by a second cap operable to actuate the rod. When actuated, the rod pushes against the first cap thereby opening it and permitting the contents of the inner and outer containers to mix. This second cap defines a plurality of holes adapted to permit a fluid or other substance to flow through them. Thus the second cap actuates the rod, yet also is disposed at the same end of the outer and inner containers from which the fluid can flow.

Figure 12:
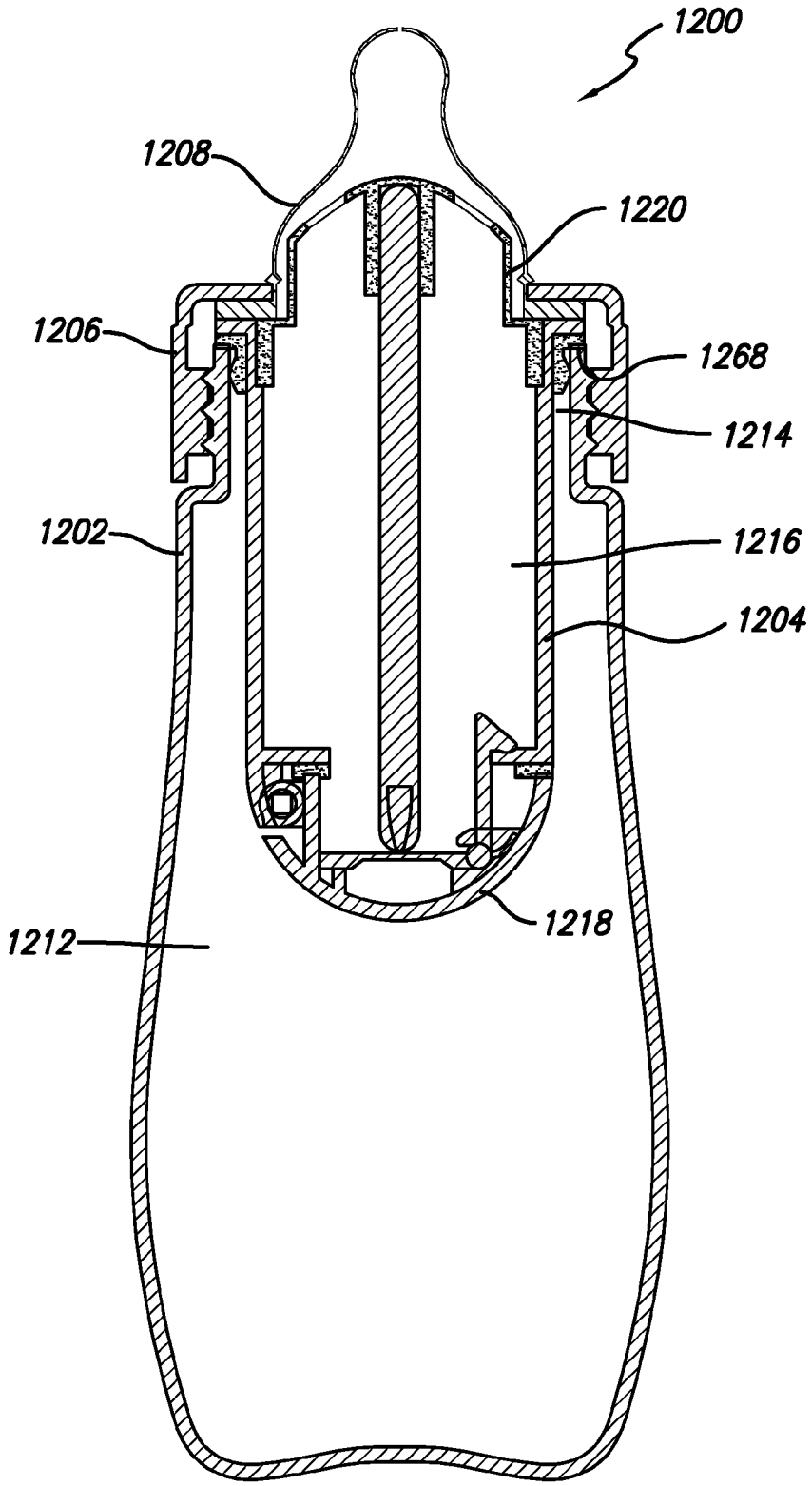
FIG. 12 is a cross section view of an assembled baby bottle according to an alternative embodiment of the invention.
Figure 13:
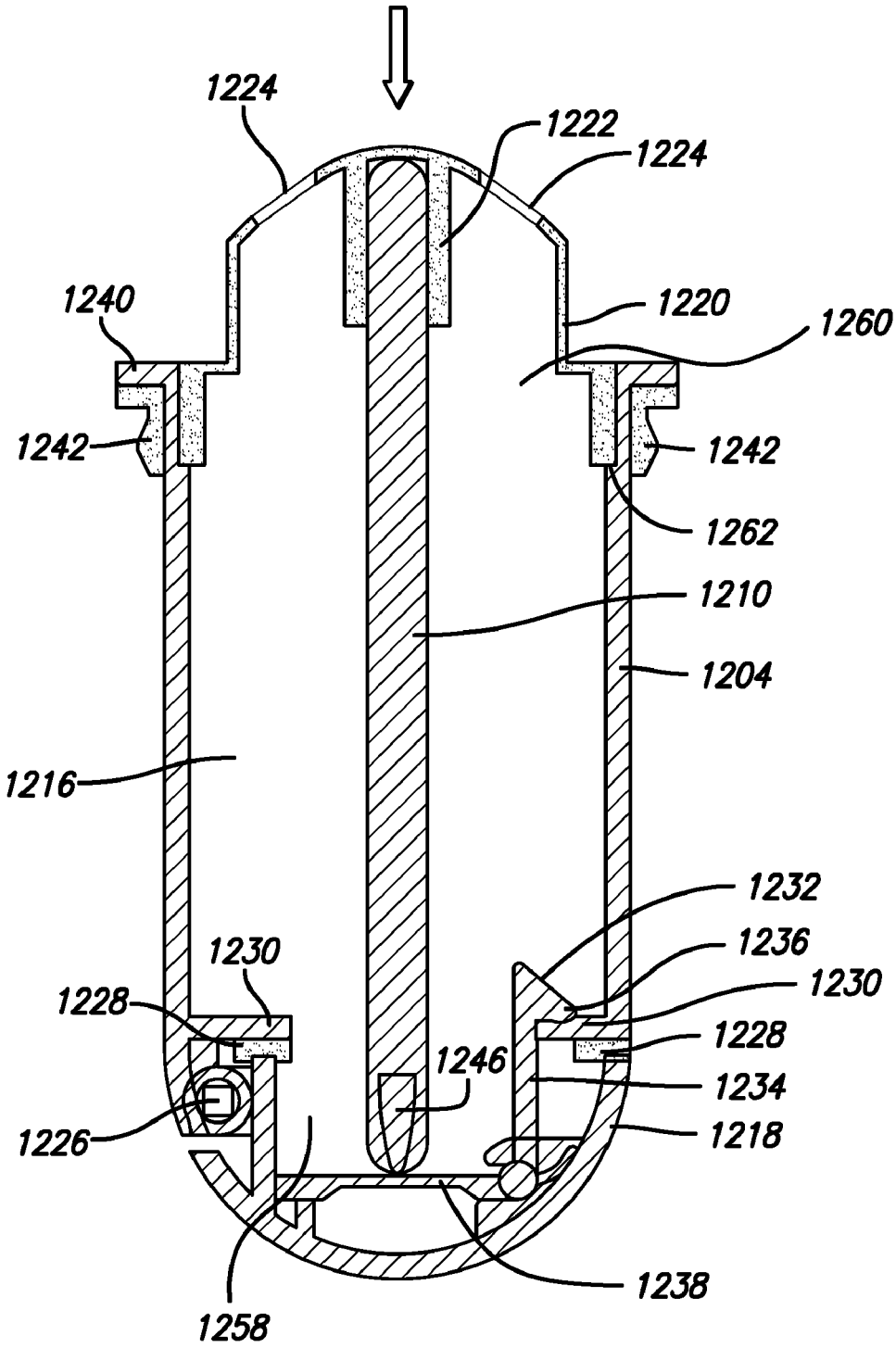
FIG. 13 is a cross section view of the second container, the second cap and the rod of the baby bottle of FIG. 12.

FIGS. 12 and 13 show a baby bottle 1200 according to this alternative embodiment. The baby bottle 1200 includes a first or outer container 1202 for holding a first substance (not shown), a second or inner container 1204 for holding a second substance (not shown), a second cap 1220, a cap ring 1206, a nipple 1208, and an operating member or rod 1210.

The first container 1202 is generally elongated in shape and defines a first or outer chamber at 1212 and a first container opening 1214 at one end of the first container 1202 and leading into the first chamber 1212. The nipple 1208 is configured to cover the first container opening 1214, and the cap ring 1206 is configured for removable, threaded engagement with the first container 1202 so that it secures the nipple 1208, the second cap 1220 and the second container 1204 in place with a fluid-tight seal.

The second container 1204 also is generally elongated in shape and defines a second or inner chamber 1216, as well as a proximate opening 1258 and a distal opening 1260, both of which lead into the second chamber 1216. The proximate opening 1258 is configured to be enclosed by a first cap 1218. The second or actuating cap 1220 (sometimes referred to as a "button") is constructed of a flexible material such a rubber or plastic, and is removably secured on the opposite end of the second chamber 1216 as that of the first cap 1218 and is configured to enclose the distal opening 1260 of the second container 1204.

The second cap 1220 includes a sleeve 1222 that is configured to mate with the rod 1210 in order to removably attach the rod 1210 to the second cap 1220. Because the second cap 1220 is constructed of a flexible material, an axial force exerted generally normally to the second cap 1220 (as shown by the arrow in FIG. 13) will cause the second cap 1220 to deform or move from a first position (as shown in FIG. 13) to a second position (not shown) wherein a portion of the second cap 1220 is deformed or pushed inwardly in the direction of the second chamber 1216 and thereby moving the rod 1210 in the axial direction shown by the arrow of FIG. 13. The second cap 1220 defines a plurality of holes 1224 for permitting a fluid or other substance to flow from the second chamber 1216 through the plurality of holes 1224, as will be described below.

The first cap 1218 is connected to the main body portion of the second container 1204 by a hinge 1226 so that the first cap 1218 can rotate between a sealing position covering the proximate opening 1258 as shown in FIG. 13 and an open position, and so that the first cap 1218 can remain pivotally connected to the second container 1204 regardless of the cap's position. The hinge 1226 is disposed within the second container 1204 but is otherwise generally of the same design and operation as the hinge previously described and illustrated in FIGS. 8, 9, 10A and 10B. A cap seal 1228 is disposed on the underside of an interior ledge 1230 extending within the second chamber 1216 so that the first cap 1218 abuts the cap seal 1228 when in the sealed position thereby providing a fluid-tight seal.

Still referring to FIGS. 12 and 13, the first cap 1218 has a latch 1232 for removably securing the cap in the sealed position. The latch 1232 is comprised of an engagement member 1234 having a tooth 1236 and a flexible member 1238 operatively connected to the engagement member 1234. In the illustrated embodiment the flexible member 1238 and the engagement member 1234 comprise an integral plastic piece. The engagement member 1234 and the tooth 1236 cooperate to engage the interior ledge 1230 disposed in the second chamber 1216 when the first cap 1218 is in the closed position, thereby inhibiting any unintentional opening movement of the first cap 1218. The flexible member 1238 is disposed adjacent to one end of the rod 1210 and is oriented generally normally to the engagement member 1234. Each end of the flexible member 1238 is mounted on separate up-right portions extending from the inner surface of the first cap 1218 so that the center portion of the flexible member 1238 is disposed in a spaced apart relationship from the inner surface of the first cap 1218.

Accordingly an axial movement of the rod 1210 in a direction away from the second cap 1220 (as shown by the arrow in FIG. 13) will push against the center portion of the flexible member 1238 thus causing it to deflect in the same direction. Because the flexible member 1238 is operatively connected to the engagement member 1234, this deflection will cause the engagement member 1234 to rotate in a direction toward the rod 1210. This will move the tooth 1236 away from the interior ledge 1230 so that the tooth 1236 is no longer in contact with the interior ledge 1230 thus releasing the first cap 1218 and allowing it to rotate from the sealed position to the open position in response to continued downward or axial movement of the rod 1210.

When the second container 1204 is removed from the first container 1202, a user can easily close and latch the first cap 1218 by manually rotating it in the closed direction with the user's hand or finger. The tooth 1236 has a ramped or angled surface that will contact the interior ledge 1230 as the cap is being closed and will cause the engagement member 1234 to slide inwardly and the flexible member 1238 to deflect. When the cap is in the fully closed or sealed position, the resiliency of the flexible member 1238 portion of the latch 1232 will cause the engagement member 1234 and the tooth 1236 to snap back into a position of engagement with the interior ledge 1230 thereby securing the first cap 1218 in the closed position.

The second container 1204 is configured to mate with the first container 1202 so that the first cap 1218 and most of the second container 1204 can be inserted through the first container opening 1214. Thus the first and second containers 1202, 1204 are in a generally coaxial relationship when they are so mated. The second container 1204 has an exterior lip or ledge 1240 located adjacent to the distal opening 1260 and an upper seal 1242 attached to the exterior ledge 1240. This ledge and upper seal 1242 are configured to abut a rim 1268 of the first container 1202 that defines the first container opening 1214 thus providing a fluid-tight seal for holding any liquid or other substance within the first chamber 1212. When the second container 1204 and the first cap 1218 are inserted into the first container 1202, the first and second chambers 1212, 1216 are sealed from one another when the first cap 1218 is in the closed or sealed position (as shown in FIG. 12). On the other hand when the first cap 1218 is in the open position, these chambers are in fluid communication with one another thereby permitting the mixing together of any substances that may have been separately stored in the chambers. Moreover, this open position is a fully-open position so that the first cap 1218 can move no further in the open direction. This allows the second container proximate opening 1258 to be fully uncovered thus exposing the full, radial cross-section area of the second chamber 1216 to the first chamber 1212 for optimum and rapid mixing of the substances.

Figure 14:
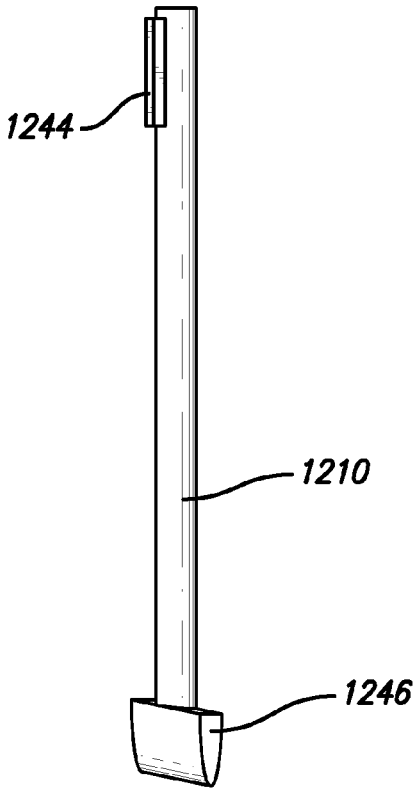
FIG. 14 is a side perspective view of the rod of FIG. 12.
Figure 15:
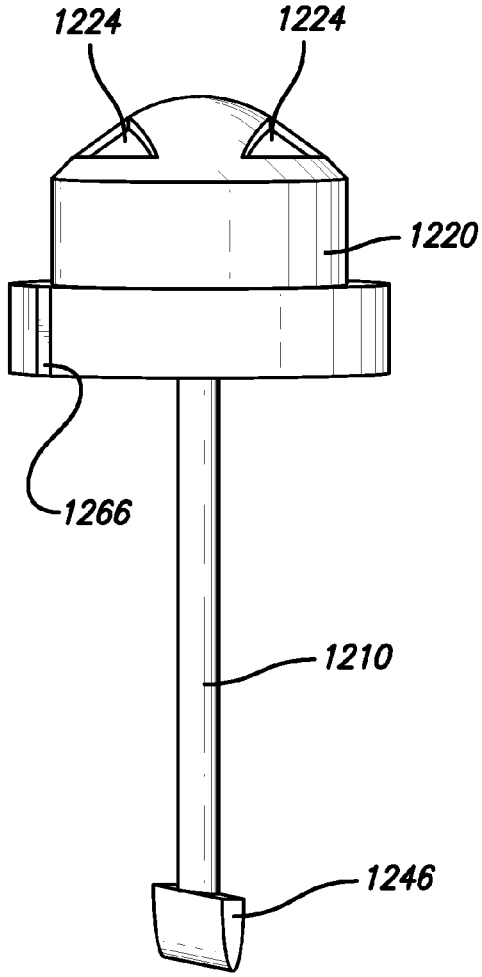
FIG. 15 is a side perspective view of the second cap and the rod of FIG. 12.

FIGS. 14 and 15 show the rod 1210 and the second cap 1220 connected to the rod 1210, respectively. At one end of the rod 1210 is a key 1244 comprised of a longitudinally shaped raised portion. The key 1244 is configured to mate with a groove (not shown) in the sleeve 1222 of the second cap 1220 in order to inhibit rotation of the rod 1210 relative to the sleeve 1222. At the other end of the rod 1210 is a wing 1246 comprised of a member extending transversely from the rod 1210 and having a generally V-shaped cross-section. The wing 1246 of the rod 1210 provides sufficient radial width to insure that it will abut the flexible member 1238 portion of the latch 1232 despite any relatively minor radial movement of the rod 1210 that may occur during its operation.

FIG. 15 depicts the plurality of holes 1224 in the second cap 1220 as previously described. In the illustrated embodiment these holes 1224 are of the same size. In alternative embodiments however holes of differing sizes may be used and may be arranged in different locations and orientations in the second cap 1220 than that shown in FIG. 15.

While FIG. 15 shows only the second cap 1220 and the rod 1210 for clarity of illustration, it should be understood that the second cap 1220 is configured for removable attachment to the second container 1204 by inserting a lower portion of the second cap 1220 into the second container distal opening 1260 and seating it against a third ledge 1262 disposed within the second chamber 1216 adjacent to the distal opening 1260 as shown in FIG. 12. Still referring to FIG. 15, the second cap 1220 includes a groove 1266 that is adapted to mate with a key or raised portion (not shown) in the inner wall of the second container 1204. This insures correct alignment between the second cap 1220 and the second container 1204 so that the wing 1246 of the similarly-keyed rod 1210 will be aligned in a generally transverse relationship with the flexible member 1238 of the latch 1232. (FIG. 13) This in turn will insure that the wing 1246 abuts the flexible member 1238 for proper actuation of the latch 1232.

Figure 16A:
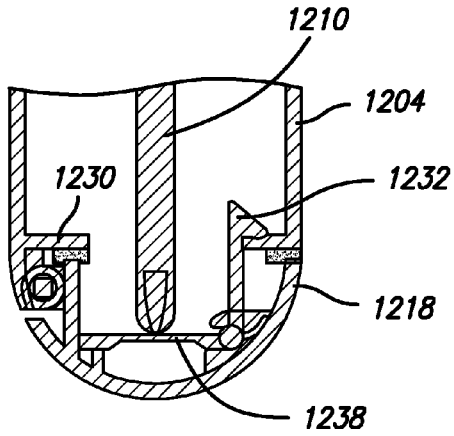
FIGS. 16A-16C are cross section views of the second cap along with a lower portion of the second container and the rod of the baby bottle of FIG. 12.
Figure 16B:
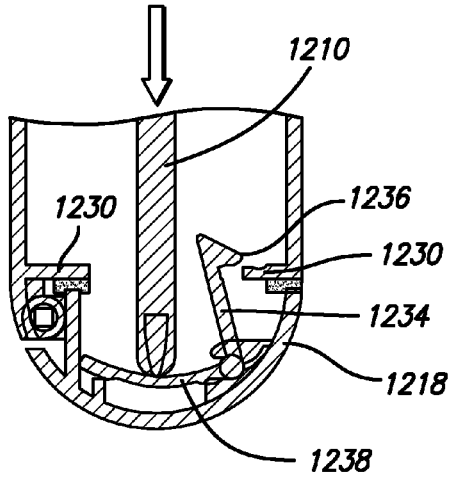
Figure 16C:
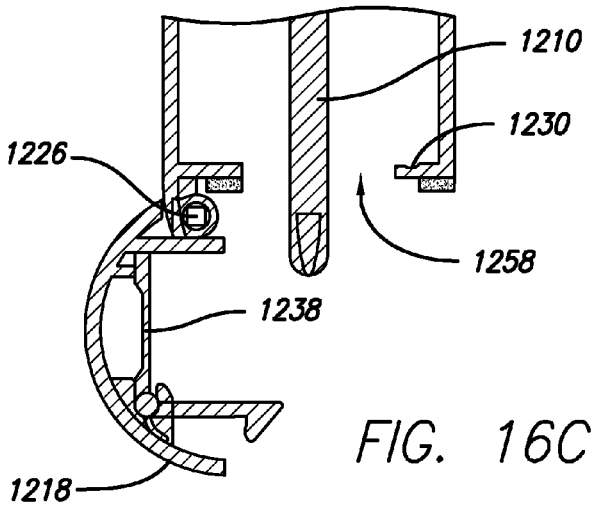

FIGS. 16A-16C illustrate the operation of the latch 1232 when actuated by the rod 1210. In FIG. 16A the first cap 1218 is in the sealed position with the latch 1232 engaged with the interior ledge 1230 of the second container 1204. While the rod 1210 lightly touches the flexible member 1238 portion of the latch 1232, no force is exerted on the flexible member 1238 in FIG. 16A. However FIG. 16B shows an axial force having no rotary component being applied to the rod 1210 in the direction of the flexible member 1238 as shown by the arrow. This force causes the flexible member 1238 to deflect in the same direction as the movement of the rod 1210. Because the flexible member 1238 is operatively connected to the engagement member 1234 and oriented generally normally to it, this deflection causes the engagement member 1234 to move or rotate in a direction toward the rod 1210. The tooth 1236 likewise moves away from the interior ledge 1230 thus releasing the first cap 1218.

Referring now to FIG. 16C, the continued axial force of the rod 1210 pushes the first cap 1218 so that rotates about the hinge 1226 and snaps into the open position. Because of the design of the hinge 1226 as previously described above, the first cap 1218 will tend to stay in the open position. With the first cap 1218 thus opened, the second container proximate opening 1258 is no longer sealed shut and accordingly the second chamber 1216 of the second container 1204 is in communication with the first chamber 1212 of the outer container 1202 thus permitting the contents of each of the first and second chambers 1212, 1216 to mix with one another. Because the hinge 1226 is disposed within the second container 1204, a portion of the first cap 1218 falls within an imaginary envelope formed by the second chamber 1216 when the first cap 1218 is in its fully-open position as best seen in FIG. 16C. This profile permits a movement of the first cap 1218 so that it can move to its fully-open position without interference or contact with the first container 1202 when the second container 1204 is mated with the first container 1202.

Figure 17C:
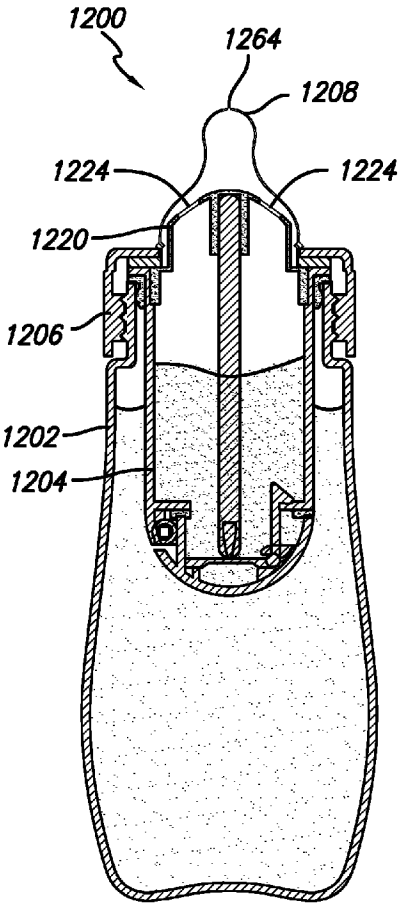
FIGS. 17A-17C are cross section views of various components of the baby bottle of FIG. 12 illustrating the stages of loading or filling the bottle.
Figure 17B:
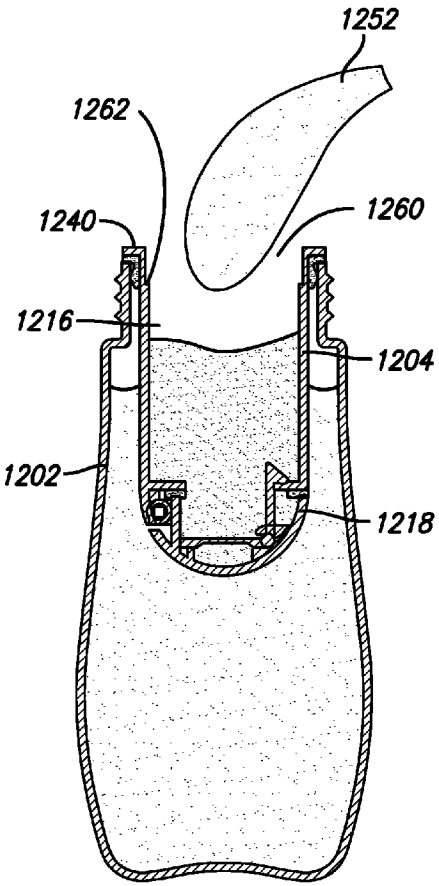
Figure 17A:
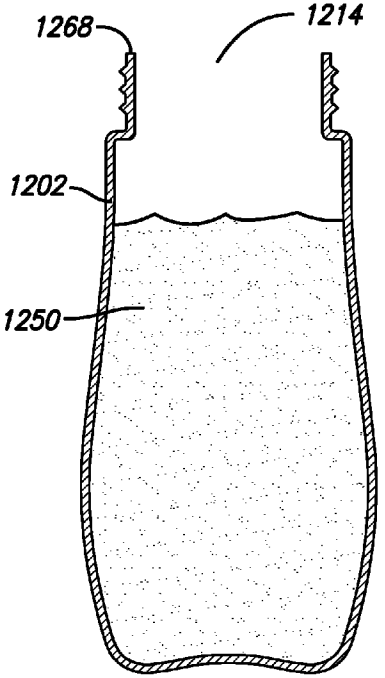

FIGS. 17A-17C illustrate a filling or loading operation of the baby bottle 1200. In FIG. 17A there is shown only the first container 1202 into which a first substance 1250, such as water, is poured through the first container opening 1214. As shown in FIG. 17B, the second container 1204 (with the first cap 1218 having been rotated and latched into the sealed position) has been inserted into the first container 1202 through the first container opening 1214 and seated on the rim 1268 of the first container 1202. With nothing covering the second container distal opening 1260, a second substance 1252, such as for example dry powder baby formula, is easily poured into the second chamber 1216 where it is prevented from mixing with the first substance 1250 by the first cap 1218 that is latched in the closed or sealed position.

FIG. 17C illustrates the final step in the filling operation. The second cap 1220 has been removably attached to the second container 1204 by inserting the lower portion of the second cap 1220 into the distal opening 1260 and seating the second cap 1220 against the third ledge 1262 of the second container 1204. The nipple 1208 is placed over the second cap 1220 and the distal opening 1260 of the second container 1204 by seating the nipple 1208 on the second container exterior ledge 1240. The cap ring 1206 is placed upon an outer rim of the nipple 1208 and is removably connected to the upper portion of the first container 1202 by a threaded engagement. Thus placed, the cap ring 1206 secures the nipple 1208, the second cap 1220 and the second container 1204 to the first container 1202. When the baby bottle 1200 is tilted from its upright position, the plurality of holes 1224 in the second cap 1220 will permit a fluid or other substance to exit the baby bottle 1200 by allowing a flow by gravity and/or suction force through the plurality of holes 1224 and through a hole 1264 defined by the nipple 1264. In normal use however one will not allow this flow to occur until after the first cap 1218 has been opened and the first and second substances 1250, 1252 allowed to mix.

Figure 18:
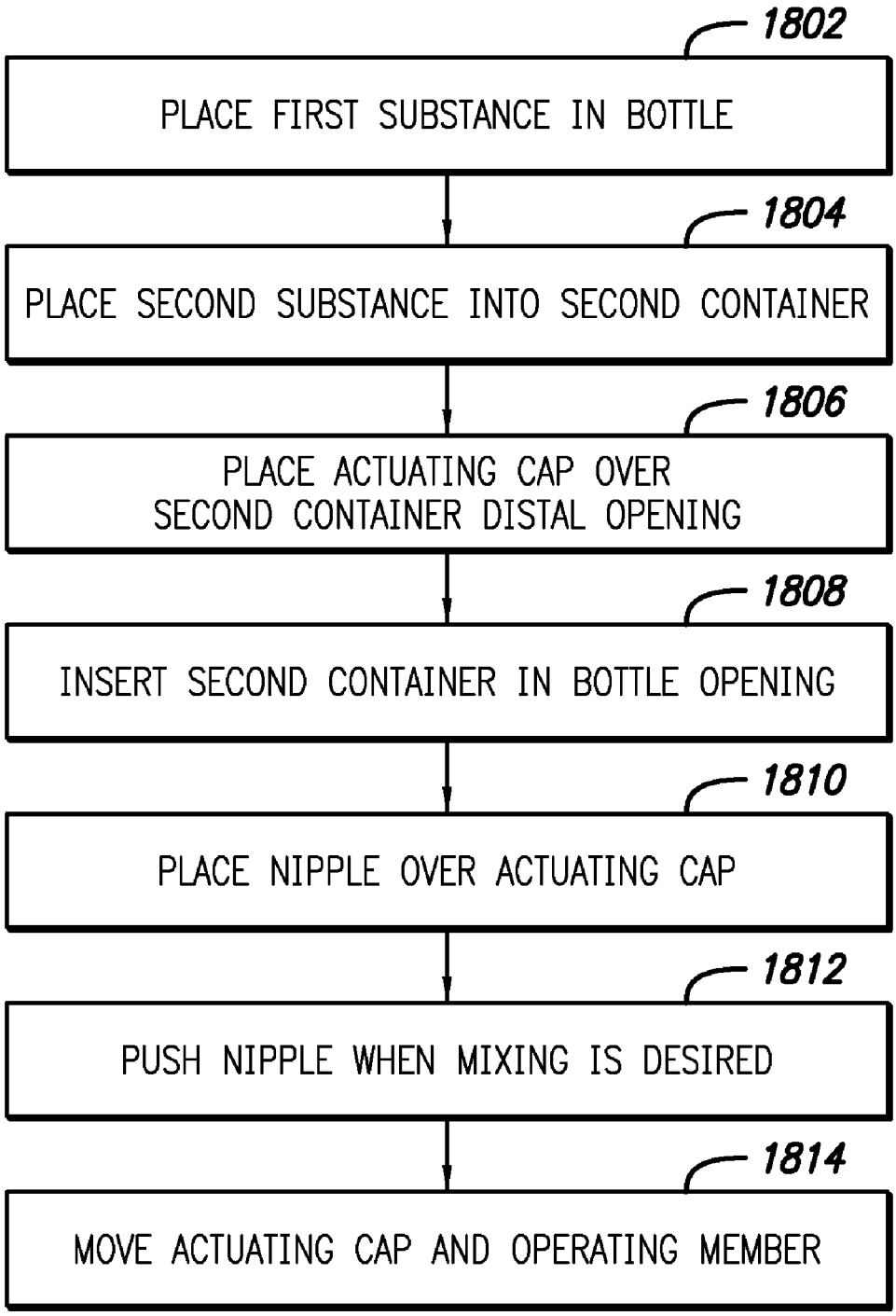
FIG. 18 is a simplified process flow diagram for a method of mixing a first substance and a second substance in accordance with another embodiment of the invention.

FIG. 18 is a simplified process flow diagram for a method of mixing a first substance and a second substance in accordance with an embodiment of the invention. In step 1802 the first substance is placed into a baby bottle through a bottle opening defined by the baby bottle. The second substance is placed into a second container, wherein the second container defines a container proximate opening and a container distal opening, and wherein the second container is configured for use with a first cap configured to cover the container proximate opening. (Step 1804) An actuating cap is placed over the container distal opening. (Step 1806) The second container is inserted into the bottle opening thereby positioning the first cap within the baby bottle. (Step 1808) A nipple is placed over the actuating cap whereupon the actuating cap, the nipple and the second container are secured to each other and to the first container. (Step 1810) When it is desired to mix the first and second substances, the nipple is pushed. (Step 1812) The actuating cap is moved in response to the pushing of the nipple thereby moving an operating member which in turn opens the first cap, thus permitting the first and second substances to mix together. (Step 1814)

It will be appreciated that the baby bottle 1200 of FIG. 12 provides an assembly that can be used, cleaned, reassembled and reused a plurality of times. The first container 1202, the second container 1204, the nipple 1208, the cap ring 1206, the second cap 1220 and the rod 1210 can all be disassembled and cleaned, and then easily reassembled by the end-user. Because the first cap 1218 of the second container 1202 is hinged, it can be easily opened and closed a plurality of times so that the first and second chambers 1212, 1216 can alternate a plurality of times between a condition of being sealed from one another and a condition of being in fluid communication with one another. Because the rod 1210 is actuated or moved by a generally axial force having no radial component, a user can cause the first cap 1218 to open (and allow the substances to mix) by pushing downward against the nipple 1264 with the user's finger in a convenient, single-handed operation.

In an alternative embodiment, the second container 1204, the second cap 1220 and the rod 1210 need not be manufactured or sold along with the outer container 1202, the nipple 1208 and the cap ring 1206. Instead the second container 1204, the second cap 1220 and the rod 1210 can be configured for use with standard baby bottles originating from other manufacturers, and can be sold or provided independently of the standard baby bottles.

Although the embodiments of FIGS. 2 and 13 show rods for use in opening a cap, alternative embodiments include other operating members having other shapes, sizes and configurations for moving a cap from a sealing position to an open position upon actuation of the operating member by a user.

Moreover while FIGS. 2 and 12 depict baby bottles, it should be appreciated that alternative embodiments of the invention include other devices and containers having other shapes and sizes and for use in separately storing at least two substances and for mixing these substances when desired. Moreover, alternative embodiments can be used for substances other than dry powder formula and water, and can include uses other than for feeding babies. These other embodiments can be for separately-stored substances that are either edible or inedible, where all of the substances are in the same form, i.e., solid, liquid or gaseous, or where the separately-stored substances are in different forms.

In view of the above, it will be appreciated that embodiments of the invention overcome many of the long-standing problems in the art by providing a device having an outer container and an inner container. Mounted at one end of the inner container is a first cap that rotates open and closed via a hinge. When the first cap is opened, the contents of the inner and outer containers are allowed to mix together. The other end of the inner container has an opening that is enclosed by a second cap operable to actuate a rod. When actuated, the rod pushes against the first cap thereby opening it and permitting the contents of the inner and outer containers to mix together.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. A device for holding a first substance and a second substance, the device comprising:

a first container defining a first chamber for containing the first substance;

a second container defining a second chamber for containing the second substance and further defining a second container proximate opening leading into the second chamber and a second container distal opening leading into the second chamber;

a first cap coupled to the second container and configured for movement from a sealing position to an open position and for movement from the open position to the sealing position, wherein the first and second chambers are in a first state when the first cap is in the sealing position, wherein the first and second chambers are in a second state when the first cap is in the open position, wherein the first state is the first and second chambers being sealed from one another, and wherein the second state is the first and second chambers being in communication with one another, wherein the first cap is configured to cover the second container proximate opening when the first cap is in the sealing position;

an operating member configured to move the first cap from the sealing position to the open position; and a second cap configured to cover the second container distal opening, wherein at least a portion of the second cap is movable between a cap first position and a cap second position, and wherein the operating member is configured to be coupled to the second cap and to be moved by the second cap when the at least a portion of the second cap moves from the cap first position to the cap second position, wherein the second cap defines a plurality of second cap holes configured to permit the first substance and the second substance to pass through the plurality of second cap holes.

2. The device of claim 1 wherein the second container includes a ledge disposed within the second chamber, wherein the first cap includes a latch, wherein the latch includes an engagement member configured to engage the ledge and a flexible member coupled to the engagement member and disposed generally normally to the engagement member, and wherein the operating member is configured to bend the flexible member thereby moving the engagement member and permitting movement of the first cap from the sealing position to the open position.

3. The device of claim 1 wherein the first container, the second container and the first cap are configured so that the first and second chambers can alternate a plurality of times between the first state and the second state during normal usage.

4. The device of claim 1 wherein each of the first container and the second container is configured for disassembly and re-assembly a plurality of times during normal usage.

5. The device of claim 1 wherein the first container further defines a first container opening leading into the first chamber, and wherein the second container is configured to mate with the first container so that the first container opening is sealed closed when the first cap is in the sealing position.

6. The device of claim 5 wherein the first and second containers are in a generally coaxial relationship with at least a portion of the second container disposed within the first chamber when the second container is mated with the first container.

7. The device of claim 1 wherein the operating member is configured to actuate the latch by an axial movement of the operating member having no rotary component.

8. The device of claim 1 wherein the at least a portion of the second cap is constructed of a flexible material, wherein the second cap is configured for removable engagement with the second container, and wherein at least a portion of the second cap is further configured to move from the cap first position to the cap second position in response to an external force applied to the second cap in a direction generally normal to the second cap.

9. The device of claim 1 wherein the operating member is a rod, wherein the second cap further comprises a sleeve, and wherein the rod is configured to mate with the sleeve.

10. The device of claim 1 wherein the first cap is pivotally connected to the second container when the first cap is both in the sealing position and in the open position.

11. The device of claim 10 wherein the first cap is pivotally connected to the second container with a hinge, wherein the hinge comprises a pin and a hinge member defining a hinge cavity configured to receive the pin.

12. The device of claim 11 wherein the pin is secured to inhibit rotation of the pin, wherein the pin has a pin cross section geometry and the hinge cavity has a cavity cross section geometry, wherein the hinge cavity has a cavity wall and is configured to permit relative rotation between the cavity wall and the pin when the first cap moves between the sealing position and the open position, and wherein the pin cross section geometry and the cavity cross section geometry are configured so that one of no stress and a first stress is exerted between the pin and the cavity wall when the first cap is in the open position, and so that a second stress is exerted between the pin and the cavity wall when the first cap is in the sealing position, wherein the second stress is greater than the one of the no stress and the first stress.

13. The device of claim 12 wherein the pin is constructed of a material having a first hardness and the hinge member is constructed of a material having a second hardness that is different than the first hardness.

14. The device of claim 12 wherein the pin cross section geometry and the cavity cross section geometry each define a shape that is generally elongated and has two generally arcuate-shaped sides connected by two generally linearly-shaped sides, wherein the pin cross section geometry includes an imaginary pin cross section longitudinal axis and the cavity cross section includes an imaginary cavity cross section longitudinal axis, wherein the imaginary pin cross section longitudinal axis is oriented generally normal to the imaginary cavity cross section longitudinal axis when the cap is in the sealed position, and wherein the imaginary pin cross section longitudinal axis is generally aligned with the imaginary cavity cross section longitudinal axis when the cap is in the open position.

15. An insert for use with a baby bottle, wherein the baby bottle includes a nipple and a first container defining a first chamber and further defining a first container opening leading into the first chamber, the insert comprising:

a second container defining a second chamber;

an actuating cap configured for attachment to the second container; and an operating member coupled to the actuating cap, wherein at least a portion of the second container is configured to be inserted into the first container opening, wherein the second container has a proximate end and a distal end, wherein the second container further defines a second container proximate opening located at the proximate end and leading into the second chamber, and a second container distal opening located at the distal end and leading into the second chamber, and wherein the second container comprises:

a first cap configured to enclose the second container proximate opening and configured for movement from a sealing position to an open position and for movement from the open position to the sealing position, wherein the first cap is coupled to the second container when the first cap is both in the sealing position and in the open position, wherein the actuating cap is configured to cover the second container distal opening and wherein at least a portion of the actuating cap is configured for movement between a cap first position and a cap second position;

wherein the actuating cap is further configured to be disposed adjacent to the nipple and wherein the at least a portion of the actuating cap is configured to move between the cap first position and the cap second position in response to an external force applied to the nipple;

wherein the operating member is configured to be moved by the actuating cap when the at least a portion of the actuating cap moves between the cap first position and the cap second position, and wherein the operating member is further configured to move the first cap from the sealing position to the open position upon movement by the actuating cap, and wherein the first and second chambers are in a first state when the first cap is in the sealing position, wherein the first and second chambers are in a second state when the first cap is in the open position, wherein the first state is the first and second chambers being sealed from one another, and wherein the second state is the first and second chambers being in communication with one another.

16. The insert of claim 15 wherein the second container further includes a ledge and a latch configured to engage the ledge, and wherein the operating member is configured to move the latch.

17. The insert of claim 16 wherein the ledge is disposed within the second chamber, wherein the latch includes an engagement member configured to engage the ledge and a flexible member coupled to the engagement member and disposed generally normally to the engagement member, and wherein the operating member is configured to bend the flexible member thereby moving the engagement member and permitting movement of the first cap from the sealing position to the open position.

18. The insert of claim 15 wherein the baby bottle is for use with a first substance and a second substance and wherein the actuating cap defines a plurality of actuating cap holes configured to permit the first and second substances to flow through the plurality of actuating cap holes.

19. The insert of claim 15 wherein the first container, the second container and the first cap are configured so that the first and second chambers can alternate a plurality of times between the first state and the second state during normal usage.

20. The insert of claim 15 wherein each of the first container and the second container is configured for disassembly and re-assembly a plurality of times during normal usage.

21. The insert of claim 15 wherein first container opening is configured to be sealed closed when the at least a portion of the second container is inserted into the first container opening and when the first cap is in the sealing position.

22. The insert of claim 15 wherein the movement of the operating member is by an axial force having no rotary component.

23. The insert of claim 15 wherein the operating member is a rod, wherein the actuating cap further comprises a sleeve, and wherein the rod is configured to mate with the sleeve.

24. The insert of claim 15 wherein the first cap is pivotally connected to the second container when the first cap is both in the sealing position and in the open position.

25. The insert of claim 15 wherein the first cap is pivotally connected to the second container with a hinge, and wherein the hinge comprises a pin and a hinge member defining a hinge cavity configured to receive the pin.

26. The insert of claim 25 wherein the hinge is disposed within the second container and wherein at least a portion of the first cap falls within an imaginary envelope formed by the second chamber when the first cap is in the open position.

27. The insert of claim 25 wherein the pin is secured to inhibit rotation of the pin, wherein the pin has a pin cross section geometry and the hinge cavity has a cavity cross section geometry, wherein the hinge cavity has a cavity wall and is configured to permit relative rotation between the cavity wall and the pin when the first cap moves between the sealing position and the open position, and wherein the pin cross section geometry and the cavity cross section geometry are configured so that one of no stress and a first stress is exerted between the pin and the cavity wall if the first cap is in the open position, and so that a second stress is exerted between the pin and the cavity wall if the first cap is in the sealing position, wherein the second stress is greater than the one of the no stress and the first stress.

28. The insert of claim 27 wherein the pin is constructed of a material having a first hardness and the hinge member is constructed of a material having a second hardness that is different than the first hardness.

29. The insert of claim 27 wherein the pin cross section geometry and the cavity cross section geometry each define a shape that is generally elongated and has two generally arcuate-shaped sides connected by two generally linearly-shaped sides, wherein the pin cross section geometry includes an imaginary pin cross section longitudinal axis and the cavity cross section includes an imaginary cavity cross section longitudinal axis, wherein the imaginary pin cross section longitudinal axis is oriented generally normal to the imaginary cavity cross section longitudinal axis if the cap is in the sealed position, and wherein the imaginary pin cross section longitudinal axis is generally aligned with the imaginary cavity cross section longitudinal axis if the cap is in the open position.

30. A device for holding a first substance and a second substance, the device comprising:

a first container defining a first chamber for containing the first substance;

a second container defining a second chamber for containing the second substance, wherein the first and second containers are configured so that at least a portion of the second container can be inserted into the first container, wherein the second container defines a second container opening leading into the second chamber, and wherein the second chamber is configured to be in communication with the first chamber via the second container opening when the second container is inserted into the first container; and means for alternately closing and opening the second container opening a plurality of times, wherein the first and second chambers are not in communication with one another when the second container opening is closed and wherein the first and second chambers are in communication with one another when the second container opening is opened.

31. A method of using a baby bottle for mixing a first substance and a second substance, the method comprising:

placing the first substance into the baby bottle through a bottle opening defined by the baby bottle;

placing the second substance into a second container, wherein the second container defines a container proximate opening and a container distal opening, and wherein the second container is configured for use with a first cap configured to cover the container proximate opening;

placing an actuating cap over the container distal opening;

inserting at least a portion of the second container into the bottle opening thereby positioning the first cap within the baby bottle;

pushing a nipple that is configured to cover the actuating cap and that is disposed adjacent to the actuating cap; and moving the actuating cap in response to the pushing of the nipple thereby moving an operating member which in turn opens the first cap.

32. The method of claim 31 wherein the actuating cap defines a plurality of actuating cap holes configured to permit the first substance and the second substance to pass through the plurality of actuating cap holes.

33. The method of claim 31 wherein the second container further includes a ledge and wherein the first cap includes a latch configured to engage the ledge, and wherein the operating member is configured to move the latch.

34. The method of claim 33 wherein the ledge is disposed within the second container, wherein the latch includes an engagement member configured to engage the ledge and a flexible member coupled to the engagement member and disposed generally normally to the engagement member, and wherein the operating member is configured to bend the flexible member thereby moving the engagement member and permitting the first cap to open.

35. The method of claim 31 wherein the actuating cap includes a sleeve and wherein the operating member is a rod, the method further comprising:

inserting the rod into the sleeve.

36. The method of claim 35 wherein the baby bottle and the second container are configured for disassembly and re-assembly a plurality of times during normal usage.

37. The method of claim 31 wherein the first cap has a sealing position and an open position, and wherein the first cap is pivotally connected to the second container when the first cap is both in the sealing position and in the open position.

38. The method of claim 37 wherein the first cap is pivotally connected to the second container with a hinge, wherein the hinge comprises a pin and a hinge member defining a hinge cavity configured to receive the pin.

39. The method of claim 38 wherein the pin is secured to inhibit rotation of the pin, wherein the pin has a pin cross section geometry and the hinge cavity has a cavity cross section geometry, wherein the hinge cavity has a cavity wall and is configured to permit relative rotation between the cavity wall and the pin when the first cap moves between the sealing position and the open position, and wherein the pin cross section geometry and the cavity cross section geometry are configured so that one of no stress and a first stress is exerted between the pin and the cavity wall if the first cap is in the open position, and so that a second stress is exerted between the pin and the cavity wall if the first cap is in the sealing position, wherein the second stress is greater than the one of the no stress and the first stress.

* * * * *